US011585560B2

(12) United States Patent
Yang et al.

(10) Patent No.: US 11,585,560 B2
(45) Date of Patent: Feb. 21, 2023

(54) METHOD OF JUDGING LACK-OF-FREON IN AIR CONDITIONER, AND AIR CONDITIONER CONTROL METHOD

(71) Applicants: Qingdao Haier Air-conditioning Electronic Co., Ltd, Qingdao (CN); Haier Smart Home Co., Ltd., Qingdao (CN)

(72) Inventors: Kun Yang, Qingdao (CN); Yunhua Ma, Qingdao (CN); Longling Ge, Qingdao (CN); Yanyao Lei, Qingdao (CN); Chao Sun, Qingdao (CN); Changyou Xiong, Qingdao (CN); Zhiyang Gao, Qingdao (CN); Yabin Sui, Qingdao (CN); Zhigao Cao, Qingdao (CN); Shouyu Liu, Qingdao (CN)

(73) Assignees: Qingdao Haier Air-conditioning Electronic Co., Ltd, Qingdao (CN); Haier Smart Home Co., Ltd., Qingdao (CN)

( * ) Notice: Subject to any disclaimer, the term of this patent is extended or adjusted under 35 U.S.C. 154(b) by 95 days.

(21) Appl. No.: 16/961,786

(22) PCT Filed: Aug. 9, 2019

(86) PCT No.: PCT/CN2019/100045
§ 371 (c)(1),
(2) Date: Jul. 13, 2020

(87) PCT Pub. No.: WO2020/134103
PCT Pub. Date: Jul. 2, 2020

(65) Prior Publication Data

US 2021/0063044 A1 Mar. 4, 2021

(30) Foreign Application Priority Data

Dec. 26, 2018 (CN) ..... 201811603281.4

(51) Int. Cl.
*F24F 11/84* (2018.01)
*F24F 11/64* (2018.01)
(Continued)

(52) U.S. Cl.
CPC ..... *F24F 11/84* (2018.01); *F24F 11/64* (2018.01); *F24F 2110/10* (2018.01); *F24F 2140/20* (2018.01); *F25B 2600/2513* (2013.01)

(58) Field of Classification Search
CPC ..... F24F 11/84; F24F 11/64; F24F 2110/10; F24F 2140/20; F25B 2600/2513
See application file for complete search history.

(56) References Cited

FOREIGN PATENT DOCUMENTS

CN 104819547 A * 8/2015 ..... F24F 11/001
CN 108592328 A * 9/2018

OTHER PUBLICATIONS

Ma, Outlet air temperature control method for air conditioner, and air conditioner, 2018, Full Document (Year: 2018).*

(Continued)

*Primary Examiner* — Nael N Babaa
(74) *Attorney, Agent, or Firm* — Maier & Maier, PLLC

(57) ABSTRACT

A method of judging lack-of-freon in an air conditioner and an air conditioner control method. The control method includes: acquiring outflow air temperatures at the first air outlet and the second air outlet, and calculating a temperature difference; comparing the temperature difference with a preset temperature difference threshold; and adjusting an opening degree of the expansion valve accordingly. In the method, the opening degree of the expansion valve can be automatically adjusted according to a result of temperature comparison to compensate for the flow rate of freon, so as to improve the cooling or heating efficiency of the air conditioning system and realize the adaptive adjustment of the air conditioner, thereby ensuring the cooling or heating (Continued)

efficiency of the system even if the system lacks freon to a slight extent and effectively reducing energy consumption. The judging method has a higher accuracy of judging result, and is easier to implement.

6 Claims, 4 Drawing Sheets

(51) Int. Cl.
*F24F 110/10* (2018.01)
*F24F 140/20* (2018.01)

(56) References Cited

OTHER PUBLICATIONS

Lin, Method and system for fluorine lacking detection and protection during startup of variable frequency air-conditioning system, 2015, Full Document (Year: 2015).*

* cited by examiner

METHOD OF JUDGING LACK-OF-FREON IN AIR CONDITIONER, AND AIR CONDITIONER CONTROL METHOD

FIELD

The present disclosure relates to the technical field of air conditioners, and more particularly, to a method of judging lack-of-freon in an air conditioner and an air conditioner control method.

BACKGROUND

Freon is usually used as a heat exchange medium in air conditioning systems. During the flow of freon in air-conditioning pipelines, indoor heat may be transferred to the outside, or outdoor heat may be transferred into the room, thus creating a comfortable living environment for the user. Affected by many factors, after long-term use of the air conditioner, freon in the pipelines may leak to different extents, resulting in a decrease in the cooling or heating effect of the air conditioner, or even shutdown of the air conditioner. Therefore, it is very important for the user of the air conditioner to know about the amount of the remaining freon in the air-conditioning system in time.

In the related art, there are various methods of judging whether the air conditioner lacks freon. For example, after a certain period of running of the air conditioner, whether the indoor temperature has reached a target temperature set by the user can be observed through somatosensing or through a thermometer. If the indoor temperature still does not reach the target temperature after a long enough time of running, it indicates that the air conditioner has a poor cooling effect and the air conditioner may lack freon; or after the air conditioner has been running for a period of time, a housing of an indoor unit is detached and it is observed whether thin tubes of an evaporator are evenly covered with condensed water, wherein if there is no condensed water adhered to either some or all sections of the tubes, it indicates that the air conditioner may lack freon; or whether the air conditioning system lacks freon is judged by detecting an air temperature difference between an air inlet and an air outlet of the indoor unit, wherein if the air temperature difference between the air inlet and the air outlet is less than a minimum temperature difference in a normal running state, it indicates that the air conditioner may lack freon; or a pressure switch may be configured to monitor whether the air conditioning system lacks freon, etc.

Existing methods of judging lack-of-freon in air conditioners each have some problems. For example, the method of measuring the indoor temperature through somatosensing or through a thermometer requires that the air conditioner be running for a long time before judging the lack-of-freon state. At this point, the air conditioner has been running for a certain period of time. If the air conditioner has been running in the lack-of-freon state from the very beginning and the user fails to find this in time, it will cause damage to the air conditioning system and increase the power consumption of the air conditioner; the method of judging whether the freon is lacking by observing the condensed water also requires that the air conditioner be running for a long time before judging, and requires that the indoor unit of the air conditioner be detached and assembled, which is inconvenient to operate; in the method of judging whether the air conditioning system lacks freon by detecting the air temperature difference between the air inlet and the air outlet, the detection result is greatly affected by the indoor temperature, and the judging result is prone to deviation; when monitoring the lack-of-freon condition in the air conditioner by the pressure switch, only after the pressure switch is turned off can the user know that the system lacks freon, that is, before the pressure switch is turned off, the air conditioner has been running in the lack-of-freon state for a very long time, which will shorten the service life of the air conditioner, increase energy consumption, and cause damage to the property of user.

Accordingly, there is a need in the art for a new method of judging lack-of-freon in an air conditioner and a new air conditioner control method to solve the above problems.

SUMMARY

In order to solve the above-mentioned problems in the related art, that is, to solve the problems that the lack-of-freon state of existing air conditioners cannot be conveniently and accurately judged, and that the running state of the air conditioners cannot be adaptively adjusted according to the degree of lack-of-freon, a first aspect of the present disclosure provides an air conditioner control method, the air conditioner including a first air outlet, a second air outlet and an expansion valve, and the air conditioner control method including:

acquiring outflow air temperatures at the first air outlet and the second air outlet, and calculating a temperature difference; comparing the temperature difference with a preset temperature difference threshold; and adjusting an opening degree of the expansion valve according to a comparison result.

In a preferred technical solution of the above air conditioner control method, the step of "adjusting the opening degree of the expansion valve according to the comparison result" specifically includes: increasing the opening degree of the expansion valve by a present opening degree, if the temperature difference is greater than the preset temperature difference threshold.

In a preferred technical solution of the above air conditioner control method, the air conditioner control method further includes: controlling the air conditioner to enter a lack-of-freon protection state after the expansion valve reaches a maximum opening degree.

In a preferred technical solution of the above air conditioner control method, the step of "controlling the air conditioner to enter the lack-of-freon protection state" specifically includes: controlling the air conditioner to shut down and/or to send an alarm.

In a preferred technical solution of the above air conditioner control method, the air conditioner control method further includes: turning on the air conditioner and running it continuously for a preset time before acquiring the outflow air temperatures at the first air outlet and the second air outlet.

In a preferred technical solution of the above air conditioner control method, the air conditioner is an embedded air conditioner.

In a preferred technical solution of the above air conditioner control method, the first air outlet is opposite to the second air outlet; or the first air outlet and the second air outlet are adjacent to each other.

In the air conditioner control method provided by the present disclosure, the outflow air temperatures at different air outlets of the same air conditioner are detected, a temperature difference is obtained through the measured outflow air temperatures, and then the temperature difference is compared with the preset temperature difference threshold; the opening degree of the expansion valve is adjusted according to the comparison result, so that when there is a large deviation between the obtained temperature difference and the preset temperature difference threshold, that is, when the air conditioning system is in a lack-of-freon state, the opening degree of the expansion valve is automatically adjusted first to compensate for the flow rate of freon, so as to improve the cooling or heating efficiency of the air conditioning system and realize the adaptive adjustment of the air conditioner, thereby ensuring the cooling or heating efficiency of the system even if the system lacks freon to a slight extent and effectively reducing energy consumption.

Further, in the process of adaptive adjustment of the air conditioner, after the opening degree of the expansion valve reaches the maximum opening degree, the air conditioner is controlled to enter the lack-of-freon protection state. Specifically, the air conditioner is controlled to shut down and/or send an alarm to remind the user that the air conditioning system lacks freon severely, and the air conditioner is turned off automatically or manually by the user to avoid continuous running of the air conditioner in the lack-of-freon state, thereby avoiding waste of electrical energy.

Further, by turning on the air conditioner and running it continuously for the preset time before acquiring the outflow air temperatures at different air outlets, and then by performing temperature measurement under the condition that the air conditioning system is running stably, the measured outflow air temperatures can be made more accurate, so as to avoid the interference of other factors with the outflow air temperatures and prevent the occurrence of a phenomenon of misjudging the lack-of-freon state by the air conditioning system.

A second aspect of the present disclosure further provides a method of judging lack-of-freon in an air conditioner, the air conditioner including a first air outlet and a second air outlet, and the method of judging lack-of-freon in the air conditioner including:

acquiring outflow air temperatures at the first air outlet and the second air outlet, and calculating a temperature difference; comparing the temperature difference with a preset temperature difference threshold; and judging a lack-of-freon state of the air conditioner according to a comparison result.

In a preferred technical solution of the above method of judging lack-of-freon in the air conditioner, the step of "judging the lack-of-freon state of the air conditioner according to the comparison result" specifically includes: judging that the air conditioner lacks freon if the temperature difference is greater than the preset temperature difference threshold.

In a preferred technical solution of the above method of judging lack-of-freon in the air conditioner, the method of judging lack-of-freon in the air conditioner further includes: turning on the air conditioner and running it continuously for a preset time before acquiring the outflow air temperatures at the first air outlet and the second air outlet.

In the method of judging lack-of-freon in the air conditioner provided by the present disclosure, the outflow air temperatures at different air outlets of the same air conditioner are detected and a temperature difference is obtained, then the temperature difference is compared with the preset temperature difference threshold, and a lack-of-freon state of the air conditioner is judged according to a comparison result. As compared with the technical solution of detecting the temperature difference between the air inlet and the air outlet in the related art, detecting the temperatures at different air outlets in the present disclosure can effectively avoid the influence of the changing room temperature on the temperature difference, make the judging result of the lack-of-freon state more accurate, and at the same time also facilitate the installation of temperature detection components.

Further, by turning on the air conditioner and running it continuously for the preset time before acquiring the outflow air temperatures at the first air outlet and the second air outlet, and by performing temperature detection after the air conditioning system runs stably, the interference of other factors with the temperature difference can be reduced, and the judging result is made more accurate.

BRIEF DESCRIPTION OF THE DRAWINGS

Preferred embodiments of the present disclosure will be described below with reference to the drawings. In the drawings.

DETAILED DESCRIPTION

Preferred embodiments of the present disclosure will be described below with reference to the accompanying drawings.

It should be understood by those skilled in the art that these embodiments are only used to explain the technical principles of the present disclosure, and are not intended to limit the scope of protection of the present disclosure. For example, although the following embodiments are explained in conjunction with a cooling process of the air conditioner, this is not limiting, and the technical solutions of the present disclosure are also applicable to a heating process of the air conditioner.

In addition, in order to better illustrate the present disclosure, various specific details are given in the following specific embodiments. It should be understood by those skilled in the art that the present disclosure can also be implemented without certain specific details. In some examples, the operation principle and internal structure of the air conditioner that are well known to those skilled in the art are not described in detail, so as to highlight the spirit of the present disclosure. In addition, terms "first", "second", "third" and "fourth" are used for descriptive purposes only, and cannot be interpreted as indicating or implying relative importance.

In addition, it should be noted that in the description of the present disclosure, terms such as "install", "connect" and "connection" should be understood in a broad sense, unless explicitly stated and defined otherwise; for example, they may indicate a fixed connection, a detachable connection or an integral connection, or may indicate a mechanical connection or an electrical connection; or may indicate a direct connection, or an indirect connection through an intermediate medium, or an internal communication between two elements. For those skilled in the art, the specific meanings of the above terms in the present disclosure may be interpreted according to the specific circumstances.

Based on the problems pointed out in the "BACKGROUND OF THE INVENTION" that the lack-of-freon state of existing air conditioners cannot be conveniently and accurately judged, and that the running state of the air conditioners cannot be adaptively adjusted according to the degree of lack-of-freon, the present disclosure provides a method of judging lack-of-freon in an air conditioner and an air conditioner control method, which aims to simplify the process of judging lack-of-freon in the air conditioner, improve the accuracy of the judging result, and adaptively adjust the running state of the air conditioner in the lack-of-freon state, thereby saving energy consumption.

Figure 1:
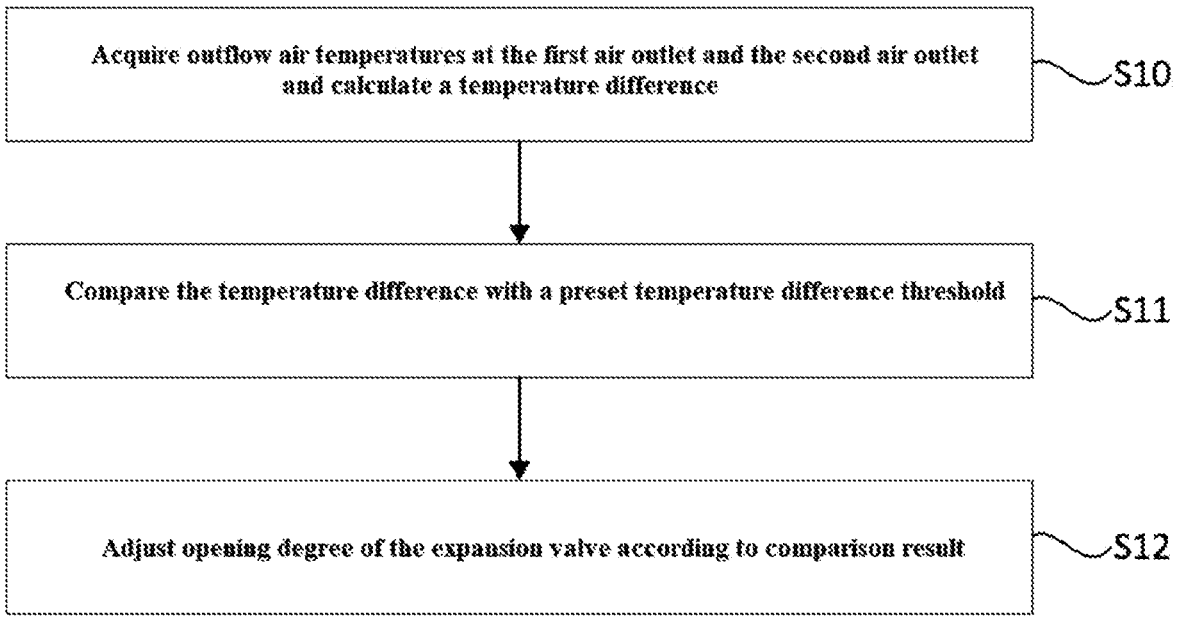
FIG. 1 is a first embodiment of an air conditioner control method of the present disclosure.
Figure 2:
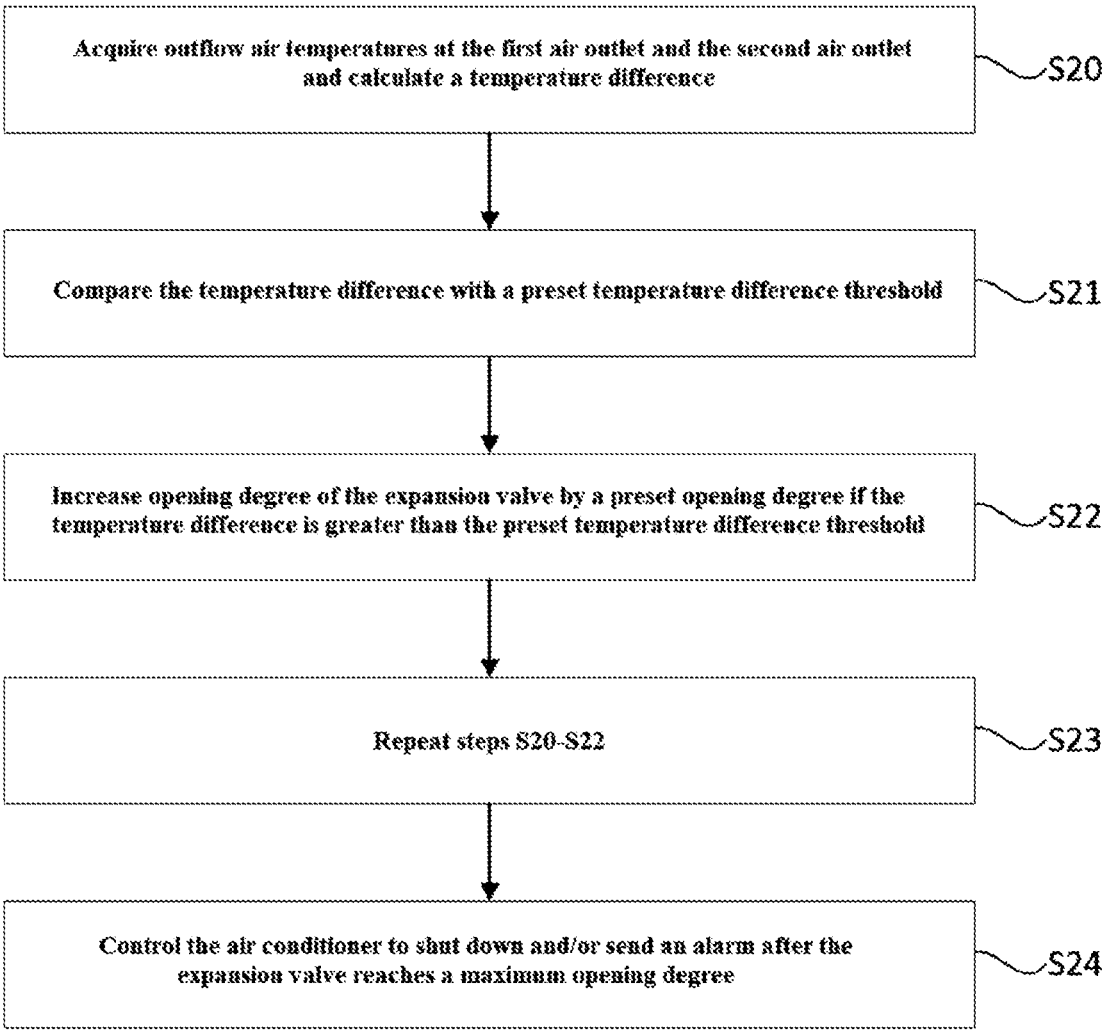
FIG. 2 is a second embodiment of an air conditioner control method of the present disclosure.
Figure 3:
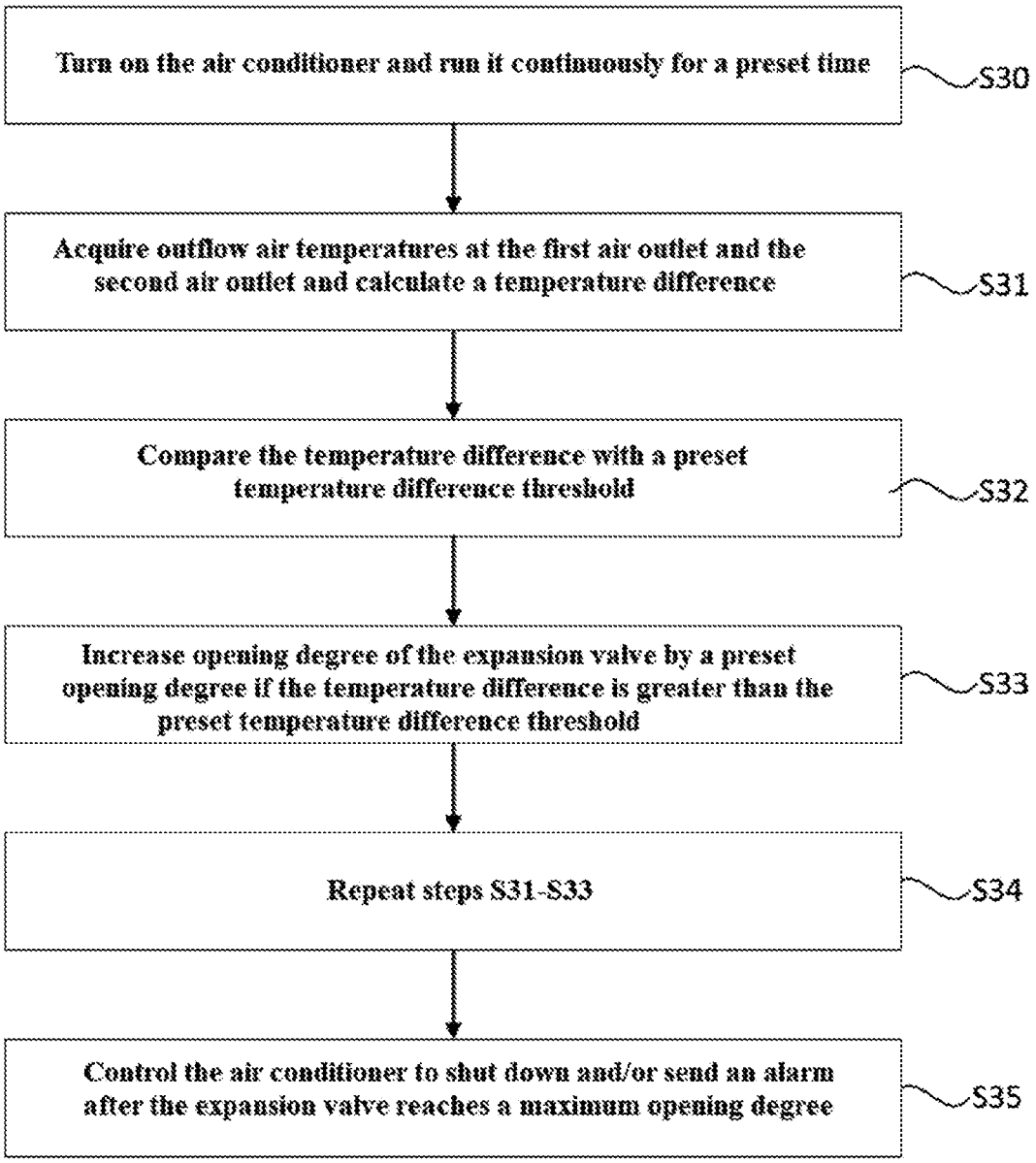
FIG. 3 is a third embodiment of an air conditioner control method of the present disclosure.
Figure 4:
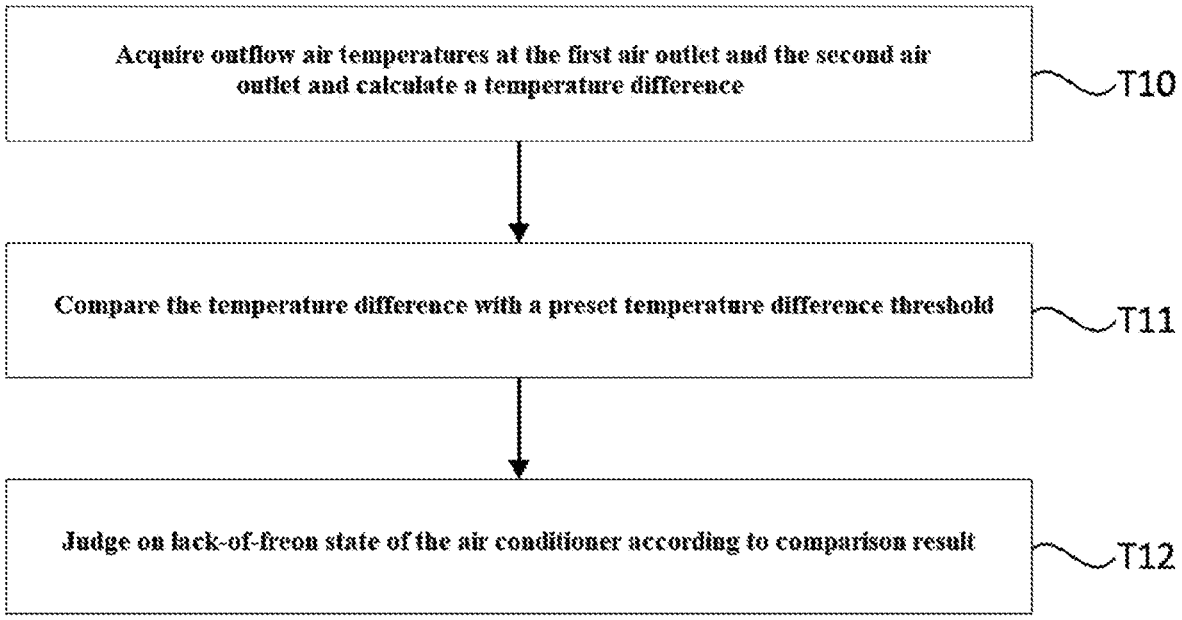
FIG. 4 is a first embodiment of a method of judging lack-of-freon in an air conditioner of the present disclosure.
Figure 5:
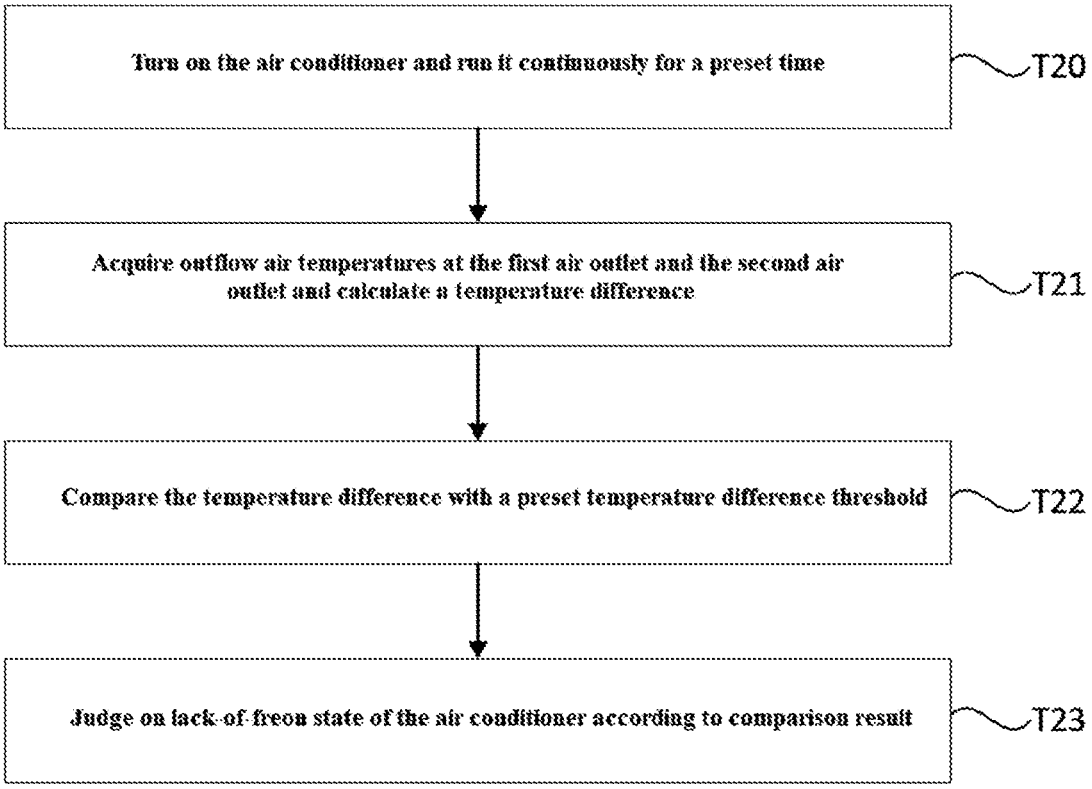
FIG. 5 is a second embodiment of a method of judging lack-of-freon in an air conditioner of the present disclosure.

Reference is made to FIGS. 1-5, wherein FIG. 1 is a first embodiment of an air conditioner control method of the present disclosure; FIG. 2 is a second embodiment of an air conditioner control method of the present disclosure; FIG. 3 is a third embodiment of an air conditioner control method of the present disclosure; FIG. 4 is a first embodiment of a method of judging lack-of-freon in an air conditioner of the present disclosure; and FIG. 5 is a second embodiment of a method of judging lack-of-freon in an air conditioner of the present disclosure.

The air conditioner provided in the following embodiments includes an indoor unit, an outdoor unit, and a pipeline connecting the indoor unit with the outdoor unit and forming a refrigerant circulation path, wherein an expansion valve is connected to the pipeline to adjust the flow rate of the refrigerant. Freon is used as the refrigerant in the subsequent description. An embedded air conditioner is used as the indoor unit of the air conditioner, and the embedded air conditioner has a plurality of air outlets, for example, four air outlets. A heat exchanger coil of the embedded air conditioner is wound to form a square spring-like structure, wherein each turn of the coil is used as a heat exchange unit, and each heat exchange unit is formed with four corners that divide each turn of the coil into four sections, so that the heat exchanger coil is divided into a first heat exchange zone, a second heat exchange zone, a third heat exchange zone, and a fourth heat exchange zone (not shown). Taking each heat exchange unit as an example, in the flow direction of the freon in the coil, the amount of cold carried by the freon gradually decreases, and the heat exchange performance gradually decreases. Assuming that the heat exchange efficiency decreases progressively at a rate of 20%, the heat exchange efficiency of the first heat exchange zone is about 90%, the heat exchange efficiency of the second heat exchange zone is 70%, the heat exchange efficiency of the third heat exchange zone is 50%, and the heat exchange efficiency of the fourth heat exchange zone is 30%, which indicates that the outflow air temperatures at the four air outlets corresponding to the heat exchange zones will have certain temperature differences. In the actual application process, when the amount of freon is sufficient, the flow rate of freon is controlled by adjusting the opening degree of the expansion valve so that the outflow air temperatures at the four air outlets can be made close to each other and the temperature differences can be made small. However, when the freon is lacking, the temperature differences of the four air outlets will change greatly. Based on the above principle, in the present disclosure, the outflow air temperatures at different air outlets are detected and a temperature difference is obtained, and then the temperature difference is compared with the preset temperature difference threshold in a normal running state to further judge the degree of lack-of-freon of the air conditioner and perform a subsequent adjustment operation according to a comparison result.

Referring to FIG. 1, the air conditioner control method in this embodiment includes:

S10. acquiring outflow air temperatures at a first air outlet and a second air outlet, and calculating a temperature difference. Specifically, in the circulation direction of the freon, an initial side of the pipeline of the heat exchanger corresponds to a first air outlet, and the subsequent air outlets correspond to a second air outlet, a third air outlet, and a fourth air outlet in sequence. That is, the first air outlet is adjacent to the fourth air outlet. If the first air outlet is still defined as the first air outlet, and the fourth air outlet is defined as the second air outlet, then the first air outlet and the second air outlet are adjacent to each other.

Alternatively, if the first air outlet is still defined as the first air outlet, and the third air outlet is defined as the second air outlet, then the first air outlet is opposite to the second air outlet. Of course, other forms may also be customized.

Temperature sensors are respectively configured at the first air outlet and the second air outlet to detect the outflow air temperatures at the corresponding air outlets. The outflow air temperature at the first air outlet is defined as $T_1$, the outflow air temperature at the second air outlet is defined as $T_2$, and then a temperature difference $|T_1-T_2|$ can be obtained. Herein, the temperature difference takes a positive number.

S11. comparing the temperature difference with a preset temperature difference threshold. Specifically, the preset temperature difference threshold is defined as $T_0$, and the value of the preset temperature difference threshold can be defined with reference to the temperature difference obtained in the case where the air conditioner has a sufficient amount of freon.

S12. adjusting an opening degree of the expansion valve according to a comparison result. Specifically, there may be the following several comparison results:

If the temperature difference is greater than the preset temperature difference threshold, that is, $|T_1-T_2|>T_0$, then the opening degree of the expansion valve is increased by a preset opening degree. For example, the expansion valve may be opened by 10 steps to increase the flow rate of freon in the pipeline, thereby improving the cooling efficiency of the air conditioner. After the opening degree of the expansion valve is increased by 10 steps, steps S10-S12 are repeated until the expansion valve is opened to a certain number of steps and $|T_1-T_2|\leq T_0$ appears, which indicates that the cooling efficiency at this point can already meet the user's requirement. The air conditioner can be controlled to continue to run in this state. This also applies to the heating process.

If the temperature difference is less than or equal to the preset temperature difference threshold, that is, $|T_1-T_2|\leq T_0$, then the air conditioner can continue to run with the opening degree of the expansion valve at this point without adjusting the expansion valve, which indicates that the air conditioner does not lack freon at this point.

In the air conditioner control method provided by the present disclosure, the outflow air temperatures at different air outlets of the same air conditioner are detected, a temperature difference is obtained through the measured outflow air temperatures, and then the temperature difference is compared with the preset temperature difference threshold; the opening degree of the expansion valve is adjusted according to the comparison result, so that when there is a large deviation between the obtained temperature difference and the preset temperature difference threshold, that is, when the air conditioning system is in a lack-of-freon state, the opening degree of the expansion valve is automatically adjusted first to compensate for the flow rate of freon, so as to improve the cooling or heating efficiency of the air conditioning system and realize the adaptive adjustment of the air conditioner, thereby ensuring the cooling or heating efficiency of the system even if the system lacks freon to a slight extent and effectively reducing energy consumption.

In some preferred embodiments, when the opening degree of the expansion valve continues to increase until it reaches the maximum, $|T_1-T_2|\leq T_0$ may still fail to appear, which indicates that the air conditioner lacks freon severely. In this situation, the air conditioner should take corresponding measures to avoid running of the air conditioner in a state of severely lacking freon. Specifically, referring to FIG. 2, the air conditioner control method in this embodiment includes:

S20. acquiring outflow air temperatures at a first air outlet and a second air outlet, and calculating a temperature difference. Specifically, the method of acquiring outflow air temperatures is the same as that in step S10. Of course, the outflow air temperatures may also be acquired by other temperature measurement methods. The acquired outflow air temperature at the first air outlet is defined as $T_1$, the outflow air temperature at the second air outlet is defined as $T_2$, and then a temperature difference $|T_1-T_2|$ can be obtained.

S21. comparing the temperature difference with a preset temperature difference threshold. The preset temperature difference threshold is defined as $T_0$.

S22. adjusting an opening degree of the expansion valve according to a comparison result. Specifically, if $|T_1-T_2|>T_0$, then the opening degree of the expansion valve is increased by a preset opening degree. For example, the expansion valve may be opened by 10 steps to increase the flow rate of freon in the pipeline.

S23. repeating steps S20-S22.

S24. controlling the air conditioner to enter a lack-of-freon protection state after the expansion valve reaches a maximum opening degree. Controlling the air conditioner to enter the lack-of-freon protection state may specifically be: controlling the air conditioner to shut down to prevent the air conditioner from running in the lack-of-freon state; or controlling the air conditioner to send a buzzer alarm to notify the user that the air conditioner lacks freon, wherein the user can manually shut down the air conditioner; or automatically controlling the air conditioner to shut down at the same time of sending an alarm to notify the user that the air conditioner is in a state of severely lacking freon.

It can be understood by those skilled in the art can understand that during the process of adaptive adjustment of the air conditioner, after the opening degree of the expansion valve reaches the maximum opening degree, by controlling the air conditioner to enter the lack-of-freon protection state, that is, by controlling the air conditioner to shut down and/or send an alarm, the user can be reminded that the air conditioning system severely lacks freon, and the air conditioner can be shut down automatically or manually by the user to avoid continuous running of the air conditioner in the lack-of-freon state, thereby avoiding waste of electrical energy.

In some preferred embodiments, in order to improve the accuracy of the temperature detection result, the temperature detection will be started after the air conditioner is turned on and has been running for a certain period of time. Referring to FIG. 3, the air conditioner control method in this embodiment includes:

S30. turning on the air conditioner and running it continuously for a preset time. For example, after the user turns the air conditioner on and sets a target temperature, the air conditioner keeps running for 5 minutes. During the 5 minutes of running of the air conditioner, the refrigerant (freon) may already be in a stable circulation state in the pipeline of the air conditioner. The original air in the air supply passage of the air conditioner has been exhausted, the air at room temperature is suctioned into the evaporator, and the outflow air temperatures at individual air outlets are also basically maintained constant.

S31. acquiring outflow air temperatures at a first air outlet and a second air outlet, and calculating a temperature difference. Specifically, the method of acquiring outflow air temperatures is the same as that in step S10. Of course, the outflow air temperatures may also be acquired by other temperature measurement methods. The acquired outflow air temperature at the first air outlet is defined as $T_1$, the outflow air temperature at the second air outlet is defined as $T_2$, and then a temperature difference $|T_1-T_2|$ can be obtained.

S32. comparing the temperature difference with a preset temperature difference threshold. The preset temperature difference threshold is defined as $T_0$.

S33. adjusting an opening degree of the expansion valve according to a comparison result. Specifically, if $|T_1-T_2|>T_0$, then the opening degree of the expansion valve is increased by a preset opening degree. For example, the expansion valve may be opened by 10 steps to increase the flow rate of freon in the pipeline.

S34. repeating steps S31-S33.

S35. controlling the air conditioner to enter a lack-of-freon protection state after the expansion valve reaches a maximum opening degree. Controlling the air conditioner to enter the lack-of-freon protection state may specifically be: controlling the air conditioner to shut down to prevent the air conditioner from running in the lack-of-freon state; or controlling the air conditioner to send a buzzer alarm to notify the user that the air conditioner lacks freon, wherein the user can manually shut down the air conditioner; or automatically controlling the air conditioner to shut down at the same time of sending an alarm to notify the user that the air conditioner is in a state of severely lacking freon.

It should be noted that the above-mentioned embodiments are only exemplary, and the numerical values appearing in the above-mentioned embodiments are also exemplary. It can be understood by those skilled in the art that the embodiments of the present disclosure can still be implemented without certain steps or with the ranges of certain numerical values being changed.

It can be understood by those skilled in the art that, by turning on the air conditioner and running it continuously for the preset time before acquiring the outflow air temperatures at different air outlets, and then by performing temperature measurement under the condition that the air conditioning system is running stably, the measured outflow air temperatures can be made more accurate, so as to avoid the interference of other factors with the outflow air temperatures and prevent the occurrence of a phenomenon of misjudging the lack-of-freon state by the air conditioning system.

On the basis of the foregoing air conditioning system, a second aspect of the present disclosure further provides a method of judging lack-of-freon in an air conditioner. In the method of judging lack-of-freon in the air conditioner, the outflow air temperatures at different air outlets are detected and a temperature difference is obtained, then the obtained temperature difference is compared with the temperature difference threshold in the normal running state to judge the degree of lack-of-freon of the air conditioner according to the comparison result, so as to provide a basis for the subsequent running of the air conditioner.

Specifically, referring to FIG. 4, the method of judging lack-of-freon in the air conditioner in this embodiment includes:

T10. acquiring outflow air temperatures at a first air outlet and a second air outlet, and calculating a temperature difference. The outflow air temperature at the first air outlet is defined as $T_1$, the outflow air temperature at the second air outlet is defined as $T_2$, and then a temperature difference $|T_1-T_2|$ can be obtained.

T11. comparing the temperature difference with a preset temperature difference threshold. The preset temperature difference threshold is defined as $T_0$.

T12. judging a lack-of-freon state of the air conditioner according to a comparison result. There may be the following several comparison results:

If $|T_1-T_2|>T_0$, it indicates that the air conditioner lacks freon, and it is necessary to add freon or increase the opening degree of the expansion valve; and If $|T_1-T_2|\leq T_0$, it indicates that the air conditioner does not lack freon, and the air conditioner can continue to run in this state until the indoor temperature reaches a target temperature set by the user.

In the method of judging lack-of-freon in the air conditioner provided by the present disclosure, the outflow air temperatures at different air outlets of the same air conditioner are detected and a temperature difference is obtained, then the temperature difference is compared with the preset temperature difference threshold, and a lack-of-freon state of the air conditioner is judged according to a comparison result. As compared with the technical solution of detecting the temperature difference between the air inlet and the air outlet in the related art, detecting the temperatures at different air outlets in the present disclosure can effectively avoid the influence of the changing room temperature on the temperature difference, make the judging result of the lack-of-freon state more accurate, and at the same time also facilitate the installation of temperature detection components.

In some preferred embodiments, in order to improve the accuracy of the result of lack-of-freon judgement, the temperature detection will be started after the air conditioner is turned on and has been running for a certain period of time. Referring to FIG. 5, the method of judging lack-of-freon in the air conditioner provided by this embodiment includes:

T20. turning on the air conditioner and running it continuously for a preset time. For example, the air conditioner keeps running for 5 minutes.

T21. acquiring outflow air temperatures at a first air outlet and a second air outlet, and calculating a temperature difference. The outflow air temperature at the first air outlet is defined as $T_1$, the outflow air temperature at the second air outlet is defined as $T_2$, and then a temperature difference $|T_1-T_2|$ can be obtained. $T_1$ and $T_2$ are acquired by temperature sensors.

T22. comparing the temperature difference with a preset temperature difference threshold. The preset temperature difference threshold is defined as $T_0$.

T23. judging a lack-of-freon state of the air conditioner according to a comparison result. Specifically, there may be the following several comparison results:

If $|T_1-T_2|>T_0$, it indicates that the air conditioner lacks freon, and it is necessary to add freon or increase the opening degree of the expansion valve; and If $|T_1-T_2|\leq T_0$, it indicates that the air conditioner does not lack freon, and the air conditioner can continue to run in this state until the indoor temperature reaches a target temperature set by the user.

It can be understood by those skilled in the art that, by turning on the air conditioner and running it continuously for the preset time before acquiring the outflow air temperatures at the first air outlet and the second air outlet, and by performing temperature detection after the air conditioning system runs stably, the interference of other factors with the temperature difference can be reduced, and the judging result is made more accurate.

Hitherto, the technical solutions of the present disclosure have been described in conjunction with the preferred embodiments shown in the accompanying drawings, but it is easily understood by those skilled in the art that the scope of protection of the present disclosure is obviously not limited to these specific embodiments. Without departing from the principle of the present disclosure, those skilled in the art can make equivalent changes or replacements to relevant technical features, and the technical solutions after these changes or replacements will fall within the scope of protection of the present disclosure.

What is claimed is:

1. An air conditioner control method, the air conditioner including a first air outlet, a second air outlet and an expansion valve, the air conditioner control method comprising:

S10: acquiring outflow air temperature T1 at the first air outlet and outflow air temperature T2 at the second air outlet, and calculating a temperature difference $|T_1-T_2|$;

S11: comparing the temperature difference $|T_1-T_2|$ with a preset temperature difference threshold $T_0$;

S12: increasing the opening degree of the expansion valve by a present opening degree, when the temperature difference $|T_1-T_2|>T_0$;

S13: repeating steps S10-S12 until the expansion valve is opened to a certain number of steps and $|T_1-T_2|\leq T_0$.

2. The air conditioner control method according to claim 1, further comprising:

controlling the air conditioner to enter a lack-of-freon protection state after the expansion valve reaches a maximum opening degree and $|T_1-T_2|\leq T_0$.

3. The air conditioner control method according to claim 2, wherein controlling the air conditioner to enter the lack-of-freon protection state comprises:

controlling the air conditioner to shut down and/or to send an alarm.

4. The air conditioner control method according to claim 1, further comprising:

turning on the air conditioner and running it continuously for a preset time before acquiring the outflow air temperatures at the first air outlet and the second air outlet.

5. The air conditioner control method according to claim 1, wherein the air conditioner is an embedded air conditioner and comprises a heat exchanger coil divided into a plurality of heat exchange areas, wherein the first air outlet and the second air outlet correspond to any two of the plurality of heat exchange areas.

6. The air conditioner control method according to claim 5, wherein the first air outlet is opposite to the second air outlet; or the first air outlet and the second air outlet are adjacent to each other.

* * * * *